United States Patent [19]

Vidal

[11] 4,116,010

[45] Sep. 26, 1978

[54] STABILIZED EARTH STRUCTURES

[76] Inventor: Henri Vidal, 8 bis, Boulevard Maillot, 92 Neuilly-sur-Seine, France

[21] Appl. No.: 726,436

[22] Filed: Sep. 24, 1976

[30] Foreign Application Priority Data

Sep. 26, 1975 [FR] France ..... 75 29600

[51] Int. Cl.[2] ..... E02D 5/20

[52] U.S. Cl. ..... 405/262; 405/286

[58] Field of Search ..... 61/39, 47, 35, 37, 4, 61/45 B

[56] References Cited

U.S. PATENT DOCUMENTS

| | | | |
|---|---|---|---|
| 2,110,253 | 3/1938 | Zur nedden | 61/39 |
| 3,192,538 | 7/1965 | Walter | 61/39 X |
| 3,316,721 | 5/1967 | Heilig | 61/39 |
| 3,683,741 | 8/1972 | Pete | 61/45 B |
| 3,686,873 | 8/1972 | Vidal | 61/39 |

FOREIGN PATENT DOCUMENTS

| | | | |
|---|---|---|---|
| 958,237 | 11/1974 | Canada | 61/39 |
| 1,634,682 | 9/1970 | Fed. Rep. of Germany | 61/39 |
| 6,514,655 | 5/1966 | Netherlands | 61/39 |
| 397,492 | 8/1933 | United Kingdom | 61/39 |

*Primary Examiner*—Dennis L. Taylor

*Attorney, Agent, or Firm*—Burns, Doane, Swecker & Mathis

[57] ABSTRACT

A structure for stablizing an earth mass, particularly an embankment. The structure includes elongated reinforcement members having transverse ribs for enhancing frictional engagement with the adjacent earth. The structure also includes skin or facing elements with brackets for connecting the reinforcement members to the skin elements. The connection between the brackets and the reinforcement members is arranged to minimize the effects of corrosion.

11 Claims, 24 Drawing Figures

STABILIZED EARTH STRUCTURES

BACKGROUND OF THE DISCLOSURE

This invention relates to stabilized earth structures, and particularly to stabilization of embankments.

In my prior U.S. Pat. Nos. 3,421,326 and 3,686,873, I have described structures which stabilize an earth mass. These prior patents disclose elongated reinforcing elements which have a substantially uniform cross section throughout their length, and which are sufficiently pliable or flexible to allow for slight displacement in a vertical direction to accommodate for uneven placement of the earth during construction of the structure. The earth adjacent the elements engages the surfaces of the reinforcing element with sufficient pressure to prevent longitudinal displacement of the reinforcement elements in the mass, although the reinforcing elements are subjected to substantial tensile forces.

Attempts have been made to increase frictional forces between the earth and the reinforcement members. For example, it has been proposed to use aluminum for the reinforcement members with its surface roughened by grooves, but this provides only a slight increase in the coefficient of friction.

A further difficulty with prior earth stabilization structures is that the metallic components are subjected to corrosion, particularly at joints. Over long periods of time, it is possible that corrosion would cause failure of one or more of the metallic components. In the past, this has been taken care of by providing metal components which have a greater cross sectional area than is necessary to support the forces anticipated. The obvious disadvantage of this technique is that additional metal is required, thereby increasing the cost.

Accordingly, it is an object of this invention to provide an improved earth stabilization structure wherein the frictional engagement between reinforcement elements and the earth mass is enhanced.

A further object of the invention is to provide an earth stabilization structure wherein metallic joints are protected from the effects of corrosion.

SUMMARY OF THE INVENTION

It has been discovered that the frictional resistance to displacement of the reinforcement elements can be enhanced by entrapping a layer of earth on the surface of the reinforcement elements, so that at least a portion of the surface of the elements acts as though it is coated with the earth.

The reinforcement elements include transverse ribs on at least one surface. Ribs may be provided on opposite sides of the reinforcement elements and, if so, the ribs are offset longitudinally. At the face of the earth mass, skin elements may be provided. The skin elements include rearwardly projecting brackets which are spaced apart from each other a distance corresponding to the thickness of the reinforcement element, and an attachment device, such as a bolt, secures the reinforcement element to the brackets.

DESCRIPTION OF THE DRAWINGS

Several preferred embodiments of the invention are illustrated in the accompanying drawings in which.

DESCRIPTION OF PREFERRED EMBODIMENTS

This invention relates to the concepts of earth stabilization disclosed in my U.S. Pat. Nos. 3,432,326 and 3,686,873. In my prior patents, the reinforcement elements are described as being capable of sustaining tension without permanently elongating and without fracture. The elements are preferably pliable or flexible and have a substantially uniform cross section shape throughout a major portion of their length. The particles which make up the earth mass include powder, sand, gravel, stones and other particles which are approximately in the form of a sphere, and do not have any one dimension which is substantially greater than another. The action of the earth mass as described in my prior patents requires frictional engagement between the earth and the reinforcement elements to provide a high resistance to displacement of the particles relative to the reinforcement elements when a load is applied.

Figure 1:
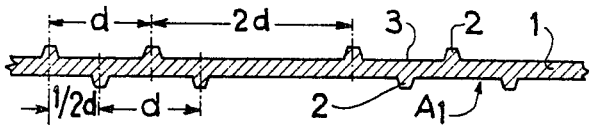
FIG. 1 is a longitudinal cross sectional view of a portion of a reinforcement element in accordance with this invention.

Referring to FIG. 1, the reinforcement element A1 comprises a strip 1 formed of a flexible material that is capable of supporting substantial tensile forces. Suitable materials include hot rolled steel. The strip 1 has a rectangular cross section (FIG. 2) and a plurality of transverse ribs 2 projecting outwardly on opposite sides of the strip 1. The ribs 2 have a generally trapezoidal shape. On each side of the strip 1, the ribs 2 are spaced apart longitudinally at intervals 3, and the surface of the strip between the ribs is substantially smooth. The spacing of the ribs on each side of the strip is the same, but the ribs of one side are offset longitudinally from the ribs on the other side.

Figure 2:
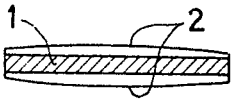
FIG. 2 is a cross sectional view of the reinforcement element along the line 2—2 in FIG. 1.

As an example of a preferred arrangement, the intervals between ribs 2 are not uniform. Successive ribs on one side are alternately spaced by the distance d (for example, d is 50 millimeters) and a distance 2d. On the opposite side of the band, the corresponding rib is offset to the middle of the space between the ribs on the upper side (1/2d). When viewed in cross section, as shown in FIG. 2, the ribs 2 slightly enlarge the profile of the band 1.

Figure 3:
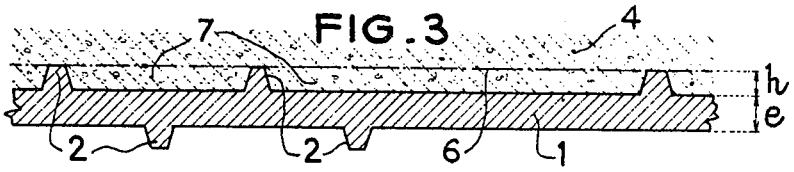
FIG. 3 is an enlarged cross sectional view as in FIG. 1 showing the interaction between the face and ribs of the reinforcement element and the earth mass.

FIG. 3 is an enlarged cross sectional view of the reinforcement member having a mass of earth particles 4 superimposed on the upper surface of the band 1. The line 6 extends across the top of the ribs 2 to define a volume of earth 7 which lies between the ribs 2 and the upper surface of the band 1. The volume of earth 7 is trapped between the ribs and becomes essentially integral with the reinforcement member. The friction force is therefore increased because the coefficient of friction between the earth particles is greater than the coefficient of friction between the free surface of the strip 1 and the earth particles.

As shown in FIG. 3 of the drawings herein, the ribs 2 are thicker at the root than at the tip, so that the ribs resist deflection. Furthermore, the height of the ribs is preferably small in order to reduce cantilever loading on the ribs Referring to FIG. 4, two reinforcement elements A1 are used in conjunction with reinforced concrete panels 8 to form a mechanically stabilized embankment, as disclosed in my prior U.S. Pat. No. 3,686,873. In accordance with this invention, a pair of brackets 9 are embedded in the concrete of the panel 8, and the opposite ends of the brackets project rearwardly. The brackets 9 are spaced apart, so that the ends extend substantially parallel to form tabs 11, which are spaced apart a distance corresponding to the thickness of the strip 1 at the end 12. The ribs 2 are spaced from the end 12. The strip 1 is secured between the two tabs 11 by a bolt 13 and a nut 14. The bolt 13 passes through aligned holes 16 and 17, respectively, in the end 12 of the strip and the tabs 11. As described in my U.S. Pat. No. 3,686,873, the space behind the panel 8 and around the enforcement members A1 is filled with a mass of particles 4 (FIG. 3), but the particles are omitted from FIG. 4 to simplify the illustration.

Figure 4:
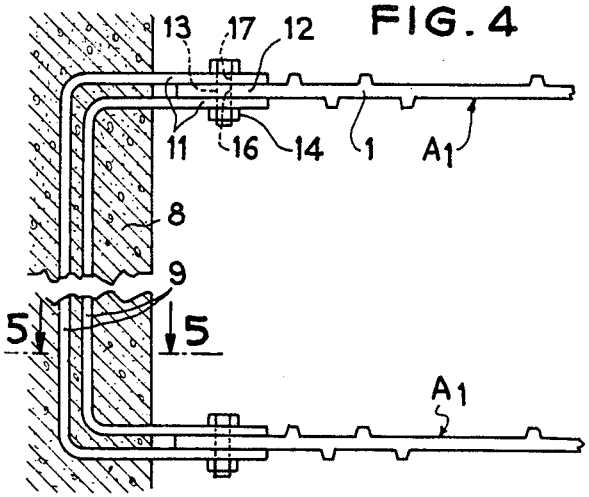
FIG. 4 is an elevational view, partially in cross section, showing a portion of a skin element and the attachment to reinforcement elements.
Figure 6:
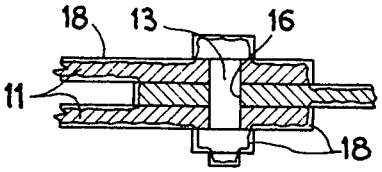
FIG. 6 is a longitudinal cross sectional view of a joint between the mounting brackets and a reinforcement element, showing schematically the effects of corrosion.
Figure 5:
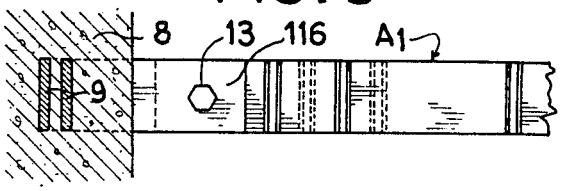
FIG. 5 is a cross sectional view along the line 5—5 in FIG. 4.

An advantage of the attachment arrangement, as shown in FIGS. 4 and 5, is that the interior portion of the end 12 and the tabs 11 is protected from the corrosive effects of moisture in the mass of particles. As shown in FIG. 6, the inner surfaces of the tabs 11 are in direct engagement with the end 12 of the reinforcement member. The bolt 13 tightly clamps these members together to exclude substantially all of the moisture, thereby protecting these mating surfaces. As a result, corrosion occurs only on the outside, as represented by the numeral 18 in FIG. 6. The cross section of the joint around the hole 16, therefore, is protected, and the life of the joint is accordingly prolonged.

Figure 8:
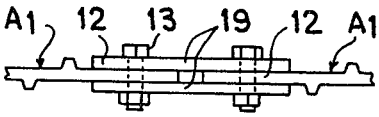
FIG. 8 is a side elevational view showing an alternative joint arrangement for reinforcement elements.
Figure 7:
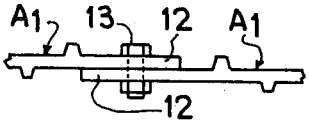
FIG. 7 is a longitudinal cross sectional view of a joint connecting the ends of two adjacent reinforcement elements.

In order to extend the length of the reinforcement members A1, a plurality of reinforcement members may be joined together at their ends, as shown in FIGS. 7 and 8. In the embodiment of FIG. 7, adjacent ends of the reinforcement members A1 are secured together by a bolt 13 which clamps the end 12 together in overlapping relation. In FIG. 8, the ends 12 are secured between plates 19 by a pair of bolts 13.

Figure 9:
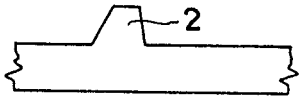
FIG. 9 is an enlarged elevational view of a rib on a reinforcement element.
Figure 10:
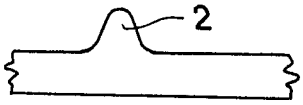
FIG. 10 is an enlarged elevational view showing an alternate form of rib on a reinforcement element.

Although the ribs 2 are shown in FIGS. 1–7 as being trapezoidal in cross section, they may be unsymmetrical, as shown in FIG. 9, or in the form of a wave, as shown in FIG. 10.

Figure 11:
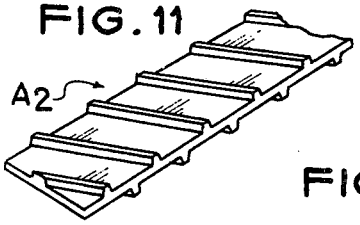
FIG. 11 is a perspective view of an alternative reinforcement element having diagonal ribs.
Figure 12:
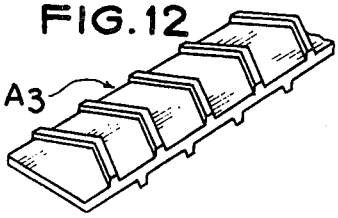
FIG. 12 is a perspective view of an alternate reinforcement element having chevron ribs.
Figure 13:
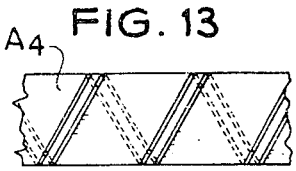
FIGS. 13, 14 and 15 are top plan views of alternative reinforcement elements having diagonal ribs in various patterns.
Figure 14:
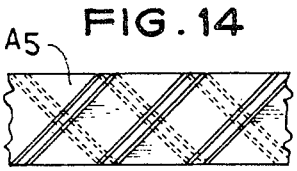
Figure 15:
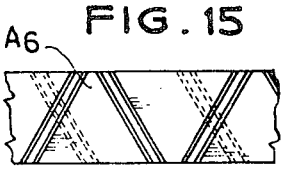
Figure 16:
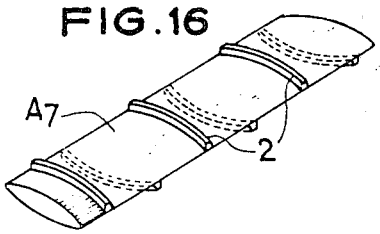
FIG. 16 is an alternative reinforcement element having an elliptical cross section.

Although the ribs 2 of FIGS. 1–8 extend at right angles to the length of the band 1, the ribs may be arranged obliquely, as shown in FIG. 11, with the ribs on one side being parallel to the ribs on the other side. As shown in FIG. 12, the ribs on the reinforcement member A3 are in the form of chevrons. FIGS. 13, 14 and 15 show reinforcement members A4, A5, and A6, respectively. In each of these modifications, the ribs extend obliquely to the longitudinal axis of the reinforcement member, but the ribs on opposite sides of the member are not parallel. The reinforcement member 7, as shown in FIG. 16, has a strip portion which is in the form of an ellipse in cross section. The ribs 2 have a corresponding curvature to present an enlargement of the strip in profile.

Figure 17:
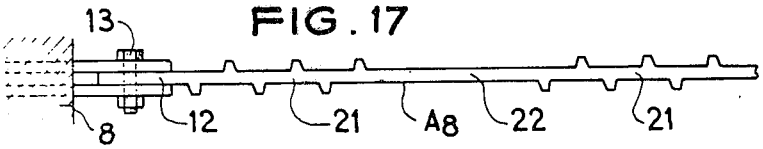
FIG. 17 is an elevational view of an alternative reinforcement element having ribs closely spaced along one portion and widely spaced along another portion.

The ribs are not necessarily spaced uniformly along the length of the reinforcement members. As shown in FIG. 17, the reinforcement member A8 has portions 21 wherein the ribs are spaced closely together and a portion 22 that is devoid of ribs. The end 12 has a smooth surface for connection with tabs projecting from the panel 8 in the same manner as shown in FIG. 4.

Figure 18:
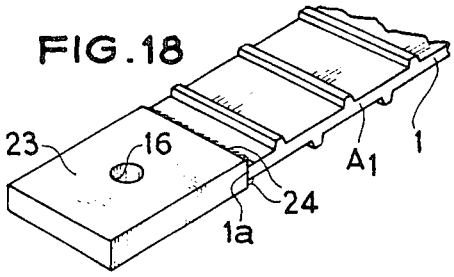
FIG. 18 is a perspective view showing the end of an alternative reinforcement element having an attachment plate.
Figure 19:
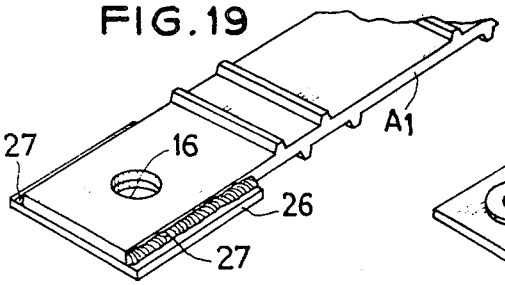
FIG. 19 is a perspective view of an end of an alternative reinforcement element with an attachment hole.
Figure 20:
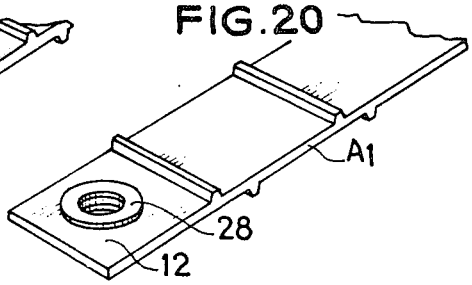
FIG. 20 is a perspective view of the end of an alternative reinforcement element having attachment washers.
Figure 21:
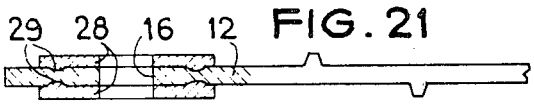
FIG. 21 is a side elevational view, partially in cross section, of the end of an alternative reinforcement element having superimposed plates with an attachment hole.

Various arrangements may be provided for the attachment and of the reinforcement members. As shown in FIG. 18, a plate 23 having a greater thickness than that of the band 1 is secured at the end of the band. A central hole 16 is provided in the plate 23 for attachment to the tabs of a panel member. The plate 23 preferably is secured to the band 1 by beads of welding 24 bonded by an adhesive. In FIG. 19, the reinforcement element A1 has an end portion 12 with a central hole 16. A reinforcement plate 26 is secured to the end 12 by welds 27 or bonded by an adhesive. The hole 16 in the plate 26 is aligned with the corresponding hold in the end portion 12 In the embodiment of FIGS. 20 and 21, the end 12 of the reinforcement member A1 is reinforced by two discs 28 on opposite sides of the strip. Preferably, the discs 28 have an angular boss 29 which is received in corresponding grooves in the end portion 12. The discs 28 are secured to the end portion 12 by resistance welding, for example. A hole 16 in the end portion 12 is aligned with the central openings in the respective discs 28.

Figure 22:
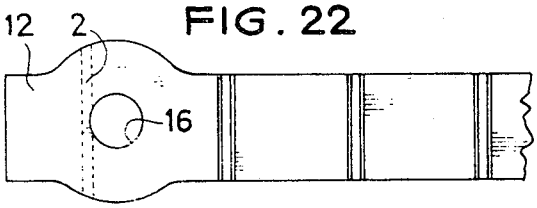
FIG. 22 is a top plan view of the end of an alternative reinforcement element enlarged around the attachment hole.

In the embodiment of FIG. 22, the end portion 12 of the metal reinforcement member is enlarged by hot forging, for example, in a manner to form the hole 16 without reducing the cross sectional area of the strip. Hot forging of the metal member permits the formation of a rib 2 during formation of enlarged end portion, if desired. For plastic reinforcement members, the hole 16 and rib 2 may be formed integral with the member.

Figure 23:
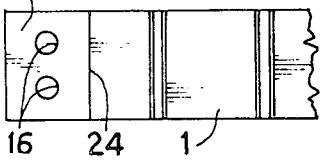
FIG. 23 is a top plan view of an alternative reinforcement element having two attachment holes.

The embodiment shown in FIG. 23 is similar to that shown in FIG. 18, except that the plate 23 is provided with two holes 16.

Figure 24:
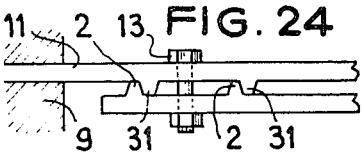
FIG. 24 is a side elevational view, partially in cross section, showing a modification of the structure of FIG. 4 utilizing the ribs to form the joint.

The attachment arrangement shown in FIG. 4 may be modified, as shown in FIG. 24, to eliminate one of the parallel tabs 11 of FIG. 4. In the modification of FIG. 24, the end of the tab 11 is provided with downwardly projecting ribs 31, which are engaged by upwardly projecting ribs 2 on the reinforcement member. The reinforcement member is assembled with the tab 11 projecting on the rearward side of the panel 9, and the attachment is held together by a bolt 13 which passes through a hole in the tab 11 and in the reinforcement member. The interlocking ribs 2 and 31 prevent longitudinal displacement between the tab 11 and the reinforcement member.

It will be understood that the assembly of a reinforcement with another reinforcement or with a fixing tab anchored in a skin element could be achieved in a way other than by bolting, for example, by a pin, stapling-clipping, forming-over, or any other suitable method.

The reinforcement according to the invention may be employed in the as-rolled condition when it is incorporated in a temporary structure in which corrosion is not to be feared. If it concerns a definitive structure, the reinforcement is advantageously protected against corrosion, for example, for steel by a hot galvanization by dipping. However, the general shape of the reinforcement and the simplicity of the relief formed by the ribs permit effecting a protection in a fully automatic manner, such as metal spraying, painting, enamelling, glazing, or coating with tar, resin or plastic.

It will be understood that the reinforcement just described may be fixed to a skin element which is not of concrete but is, for example, constituted by a metal section, as disclosed in my U.S. Pat. No. 3,421,326.

An example of a preferred reinforcement member in accordance with this invention is a metal member having a substantially rectangular cross section with a width of between 40 and 60 millimeters and a thickness of 5 millimeters. The ribs have a height of 3 millimeters. For work exposed to sea water, the metal member has a thickness of between 8 and 12 millimeters, with ribs of 3 millimeters and a width of 40 to 60 millimeters.

In regard to the transverse ribs 2 on the reinforcement elements, it should be understood that these ribs function in a different manner from the deadman effect utilized, for example, in the structure disclosed in Munster U.S. Pat. No. 1,762,343. In the Munster device, transverse wood blocks are spaced between longitudinal members, and project above the surface of the longitudinal members. Thus, the transverse members of Munster are blocked from movement through the soil and act as deadmen to hold the wall against earth pressure. Of course, in order for this type of deadman structure to be effective, it must be placed far enough from the wall to be secured in the earth firmly and not in the earth filldirectly behind the wall.

Another structure that has been proposed is disclosed in French Pat. No. 1,173,383 (Lallemand). This patent discloses earth stabilization structures in which a longitudinal member is provided with transverse projections. The elongated member is then placed in the earth fill, so that the projections act as deadmen in substantially the same manner as disclosed in the Munster patent. The transverse projections as disclosed in the French patent to Lallemand are thin and apparently are flexible, so that they are not capable of trapping a body of particulate material between the projections as do the transverse ribs 2 of the structure of my invention.

While this invention has been illustrated and described with respect to several preferred embodiments, it is recognized that variations and changes may be made therein without departing from the invention as set forth in the claims. Specifically the reinforcement may be of any metal or any other material, such as plastics material, wood, etc.

What is claimed is:

1. A stabilized earth structure comprising a mass of earth, a plurality of reinforcing elements embedded in the mass, said reinforcing elements being elongated and pliable and being capable of sustaining tension without permanently elongating and without fracture, a portion of said earth being in direct frictional engagement with one surface of said reinforcing elements, said one surface having a plurality of ribs spaced apart longitudinally of said element, said ribs having a height of about 3 millimeters, said earth being pressed against said one surface with sufficient pressure to be retained by said ribs and to become an integral part of said reinforcing element, and thereby increasing frictional resistance between said earth mass and said reinforcing elements.

2. A stabilized structure according to claim 1 wherein the height of the ribs is less than the thickness of the reinforcing element.

3. A stabilized structure according to claim 1 wherein the ribs are perpendicular to the length of the reinforcing elements.

4. A stabilized earth structure according to claim 1 wherein the ribs extend obliquely to the longitudinal axis of the reinforcing element.

5. A stabilized earth structure according to claim 1 wherein the ribs have a chevron shape.

6. A stabilized earth structure according to claim 1 wherein said reinforcing element has a surface opposite to said one surface, and said opposite surface has a plurality of ribs spaced longitudinally of said reinforcing element.

7. A stabilized earth structure according to claim 6 wherein said ribs on said opposite surface are longitudinally offset from said ribs of said one surface.

8. In a stabilized earth structure of the type having a plurality of reinforcing elements embedded in a mass of earth, said mass having a face along at least one side of the mass, said reinforcing elements being elongated and pliable and being capable of sustaining tension without permanently elongating and without fracture, said earth mass being in direct frictional engagement with opposed surfaces of said reinforcing elements, the improvement wherein said opposed surfaces reinforcing elements have a plurality of transverse ribs spaced apart longitudinally of said elements, said ribs having a height of about 3 millimeters, said ribs on one surface of a reinforcing element being longitudinally offset from the ribs on the opposite surface of said element, said earth mass filling the space between said ribs and engaging substantially the entirety of said opposed surfaces.

9. The stabilized earth structure according to claim 8 wherein said opposed surfaces are substantially flat between said ribs, and said ribs are of equal height.

10. The stabilized earth structure according to claim 8 wherein said ribs are thicker at their base than at their tip to resist deflection.

11. The stabilized earth structure according to claim 8 wherein said reinforcing elements have a thickness of between 5 and 12 millimeters.

* * * * *